United States Patent [19]

Van Driesen et al.

[11] Patent Number: 4,744,887

[45] Date of Patent: May 17, 1988

[54] SOLID ADDITION AND WITHDRAWAL

[75] Inventors: Roger P. Van Driesen, Titusville; William R. Adams, Upper Montclair; Mario Baldasarri, Paramus; John Caspers, Basking Ridge, all of N.J.; Harold Trimble, Grove, Tex.

[73] Assignee: Lummus Crest Inc., Bloomfield, N.J.

[21] Appl. No.: 811,491

[22] Filed: Dec. 20, 1985

[51] Int. Cl.[4] ..... C10G 13/00

[52] U.S. Cl. ..... 208/152; 208/173; 208/176; 208/143

[58] Field of Search ..... 208/150, 152, 159, 173, 208/176, 164, 157, 143, DIG. 1

[56] References Cited

U.S. PATENT DOCUMENTS

| | | | |
|---|---|---|---|
| 2,474,583 | 6/1949 | Lewis, Jr. | 208/159 X |
| 2,605,214 | 7/1952 | Galstaun | 208/152 |
| 3,547,809 | 12/1970 | Ehrlich et al. | 208/176 X |
| 3,849,295 | 11/1974 | Addison | 208/150 X |
| 3,873,441 | 3/1975 | Jones | 208/173 X |
| 4,018,671 | 4/1977 | Andon et al. | 208/152 |
| 4,059,502 | 11/1977 | James | 208/152 |
| 4,576,712 | 3/1986 | Greenwood | 208/173 X |

*Primary Examiner*—Helen M. S. Sneed
*Assistant Examiner*—Glenn Caldarola
*Attorney, Agent, or Firm*—Elliot M. Olstein

[57] ABSTRACT

A system for adding and withdrawing solids to a high pressure reactor wherein there is provided improved control of flow and concentrations of a slurry of solids in a transport oil for introducing and withdrawing solids from the reactor. In addition, there is provided for improved heating and cooling of the solids.

6 Claims, 1 Drawing Sheet

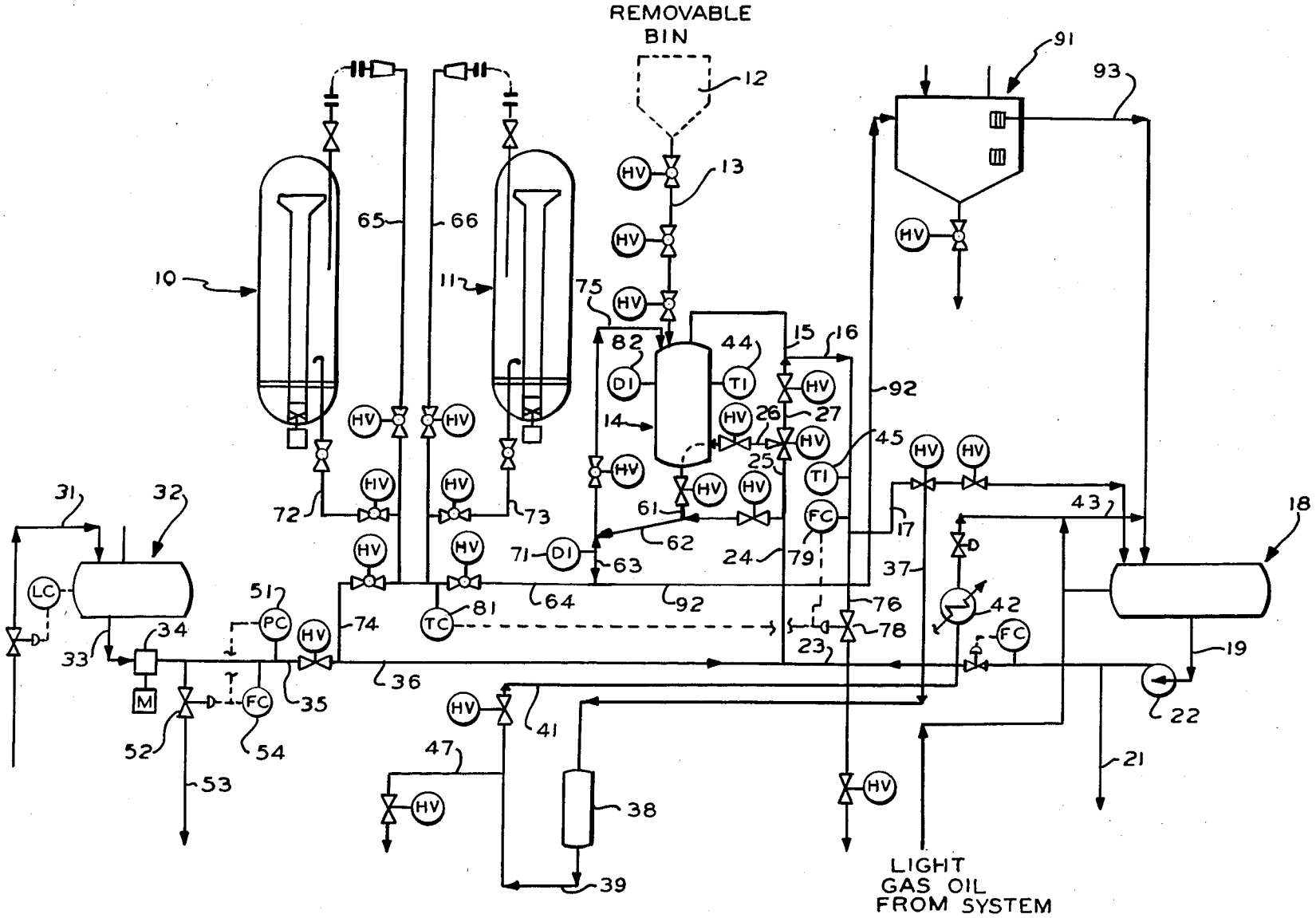
REMOVABLE BIN
LIGHT GAS OIL FROM SYSTEM

SOLID ADDITION AND WITHDRAWAL

This invention relates to adding and withdrawing solids, and more particularly to the addition and withdrawal of solids from a high pressure reaction vessel, such as that employed in a hydrogenation process.

In many cases, it is necessary to add and withdraw solids to and from a high pressure vessel, such as a vessel employed for the hydrogenation of a feed.

U.S. Pat. No. 3,547,809 discloses a process and system for adding and withdrawing solids, to and from a high pressure reaction vessel, and in particular a reaction vessel for hydrogenating a feed by using an expanded bed of catalyst. The aforesaid patent discloses the use of a transport liquid by which a slurry of catalyst solids is added to and from a high pressure vessel.

The present invention is directed to improving a system and process for adding and withdrawing solids to and from a high pressure vessel by use of a transport liquid in which the solids are carried to and from the vessel as a slurry in a transport liquid.

In accordance with one aspect of the present invention, there is provided a process and system for adding and withdrawing solids by use of a transport liquid wherein there is provided improved control during the addition and/or withdrawal.

In accordance with another aspect of the present invention, there is provided an overall improvement in the system by providing a system and process in which the same transfer vessel can be employed for introducing solids into and withdrawing solids from a reactor, and in particular a high pressure reactor.

In accordance with still another aspect of the present invention, there is provided an improved solids addition and withdrawal system and process which provide for both heating of solids prior to being added to a reactor, and cooling of the solids prior to being withdrawn from the system.

In accordance with yet another aspect of the present invention, there is provided improved sequencing for the addition and withdrawal of solids from a reactor.

More particularly, there is provided a system and process wherein during addition of solids, the flow of the slurry of solids in transport liquid is controlled by maintaining a predetermined flow rate of transport liquid to the transfer vessel, without changing such flow rate in response to pressure changes in the transport liquid. In this manner, the solids are added without imposing and controlling the pressure difference between the transfer vessel and reactor. In this manner, the velocity of the slurry can be effectively controlled so as to minimize saltation and/or erosion. Moreover, in such transfer, in accordance with a preferred embodiment, the solids are transferred from the transfer vessel by introducing a portion of the transport liquid directly into the bottom of the vessel and the remainder above the solids in the vessel and the concentration of solids in the liquid removed from the vessel is controlled by proportioning the respective introduction of liquid into the bottom and top of the vessel.

In addition, in the system, there is provided an improvement in the control of the rate of withdrawal of solids including reaction liquid from a reactor wherein the solids are slurried in a transport liquid by regulating the flow of transport liquid and reaction liquid removed from the catalyst withdrawal system so as to maintain either a predetermined flow rate or to maintain a predetermined temperature of the transport liquid containing slurried withdrawn solids. In this manner, the concentration of solids in the transport liquid is controlled.

In addition, there is provided an improvement in the addition and withdrawal of solids by providing separate systems for heating and cooling the solids in a solids transfer vessel, and by providing in the cooling system, a closed loop cooling system whereby temperature cycling is avoided and the impact of the cooling cycle, on remaining portions of the system, is minimized and/or eliminated.

Furthermore, there is provided a process and system wherein the liquid used for transporting the solids to a reactor is a hot transport liquid, wherein the heated or hot transport liquid is provided in a heated condition from the overall reaction system and wherein the transport liquid is returned to the reaction system. Similarly, the liquid which is employed for washing solids is provided from the overrall reaction system, and after use, the washing liquid may be returned to the reaction system.

These and other aspects of the present invention will be more fully understood with respect to a preferred embodiment of a solids addition and withdrawal system and process as illustrated in the accompanying drawing, wherein:

The drawing is a simplified schematic representation of a solids addition and withdrawal system.

Referring now to the drawing, there is shown a first reactor 10 for hydrogenating a feedstock in an expanded bed and a second reactor 11 for also hydrogenating a feedstock in an expanded bed. The embodiment will be described with respect to adding catalyst to reactor 10, followed by withdrawing catalyst from reactor 11. The system is described with respect to adding catalyst prior to withdrawing catalyst in that such a sequence is preferred where the same transfer vessel is used for adding and withdrawing solids in that such a sequence significantly reduces overall times for addition and withdrawal. It is to be understood, however, that where different transfer vessels are used for adding and withdrawing solids, preferably the initial part of the cycle is withdrawing catalyst from the reactor, followed by adding catalyst to the reactor. Moreover, the system will be described with respect to a preferred embodiment wherein a single catalyst transfer vessel is employed for both catalyst addition and withdrawal; however, it is to be understood that the system may include two catalyst transfer vessels, each of which can be employed for both catalyst addition and withdrawal, or in the alternative, the system may include two catalyst transfer vessels, with one vessel being dedicated to withdrawing catalyst and the other being dedicated to adding catalyst.

It is also to be understood that all of the various valving and the like which are included in the system for isolating high pressure portions from low pressure portions of the system, and for controlling the various flow streams during the various steps have not been shown for the purposes of simplifying the drawing and description thereof. It is deemed that the placing of appropriate valving would be within the scope of those skilled in the art from the teachings herein.

Fresh catalyst in bin 12 flows by gravity through line 13 into catalyst transfer vessel 14 which is filled with an oil, which is preferably a light gas oil. Alternatively, the vessel 14 may be empty and filled with air at atmosphere pressure. Vessel 14 is preferably at ambient temperature. Filling continues until the catalyst reaches the desired level; for example, as indicated by density detector 82. Light gas oil in vessel 14 is displaced therefrom through lines 15, 16 and 17 into a cooling oil circulation drum 18. Accumulated oil may be withdrawn from drum 18 at a desired rate through lines 19 and 21 to the appropriate portion of the fractionation section in the separation and recovery section for the hydrogenation reaction system. Air which may be in the pores of the catalyst is displaced by the light gas oil in the catalyst transfer vessel 14.

Any air which may remain in the transfer vessel 14 is displaced by circulating oil from the drum 18 through line 19, pump 22, line 23, line 24, line 25 and line 26 for introduction into the catalyst transfer vessel 14. The oil introduced into vessel 14 overflows through lines 15, 16 and 17 for return to the drum 18.

If the vessel 14 is free of oil when loaded, the vessel is purged with, for example, an inert gas such as nitrogen.

The vessel 14 now contains fresh catalyst, and the next portion of the cycle involves heating the catalyst in vessel 14.

For this purpose, a hot transport oil is obtained from the separation and recovery portion of the overall reaction system. Thus, for example there may be obtained a hot heavy gas oil from the separation and recovery portion of the overall reaction system, which hot heavy gas oil in line 31 is introduced into a transport oil service drum 32. In this portion of the cycle, the hot transport oil in drum 32 flows therefrom through line 33, pump 34, line 35, line 36, line 24, line 25, and line 26 from which the transport oil is introduced into transfer vessel 14. The heavy gas oil overflows from vessel 14 through line 15, line 16, line 37, through filter 38 and then through lines 39, 41 and cooler 42 for introduction into the drum 18 through line 43.

At the time that the temperature of the oil in line 16 reaches a predetermined temperature, as indicated by temperature indicator 45, the heavy gas oil which overflows vessel 14 and eventually reaches line 39 is diverted to the separation and recovery portion of the reaction system through line 47; for example to an atmospheric tower. Thus, heavy gas oil no longer flows through line 41, etc. to the drum 18.

The hereinabove described flow continues until the temperature indicator 44 which measures the temperature of vessel wall 14 and the temperature indicator 45 indicates that the transfer vessel 14 and the fluid in line 16, respectively, have reached predetermined temperature values which are suitable for introducing catalyst into the vessel 10. At this point, the pressurization of the system to a pressure higher than the pressure prevailing in the reactor 10 is initiated. Thus, for example, the system may be pressurized to a pressure which is at least 200 psi above the pressure prevailing in reactor 10. The high pressure portion of the system includes the flow lines to reactor 10, as hereinafter described, and the flow lines for withdrawing catalyst from reactor 11, also as hereinafter described.

The system is pressurized by use of a pressure controller 51, which operates a valve 52 in line 53, which is in fluid flow communication with the pump 34 so as to cause the main portion of the fluid withdrawn from pump 34 to flow through line 53 to the separation and recovery portion of the reaction system. During the pressurization portion of the cycle, the set point of the pressure controller 51 is increased at a predetermined rate to the desired pressure, and the pressure controller 51 controls valve 52 so as to divert a portion of the hot transport oil into line 35 in an amount which maintains the desired pressuring rate in the high pressure portion of the catalyst addition system. During pressurization, hot transport liquid is introduced into the high pressure portion of the system, including vessel 14, without withdrawing transport liquid therefrom, and without introducing transport liquid into the reactors.

Once the system reaches the desired pressure and catalyst is to be added, valve 52 is controlled by flow controller 54 instead of pressure controller 51 so as to maintain a predetermined rate of flow of hot transport oil through line 36 for introduction of catalyst into the reactor 10, without changing the flow rate in response to pressure differences of the transport oil which flows through line 36; i.e., the transport oil is flow controlled rather than pressure controlled. In the catalyst addition portion of the cycle, the transport oil initially flows through line 36, line 24, line 25, and line 26 into the catalyst transfer vessel where catalyst is slurried in the transport oil. The transport oil having catalyst slurried therein, then flows through line 61, line 62, line 63, line 64 and line 65 into the top of reactor 10. In this manner, catalyst is directly added to reactor 10. As should be apparent, if catalyst was to be added to reactor 11, then the catalyst slurried in the transport oil in line 64 would flow through line 66 for introduction into reactor 11.

In order to control the concentration of solids in the transport liquid which flows out of vessel 14 through line 61, a portion of the transport liquid is to be diverted through lines 27 and 15 into the top of vessel 14. The concentration of solids is controlled by controlling the relative amounts of liquid introduced through lines 15 and 26, with an increase of liquid introduction through line 15 increasing the concentration of slurried solids.

The proportions of liquid introduced into the vessel 14 through lines 15 and 26 may be automatically controlled by use of the density detector 71 in line 63 so as to maintain a density which corresponds to the desired slurry concentration. It is to be understood, however, that other control methods may be employed.

As hereinabove indicated during the addition of catalyst, the flow of transport oil in line 36 is maintained at a predetermined rate by the flow controller 54 Consequently, the volumetric flow rate of slurry withdrawn from vessel 14 through line 61 is set. The flow rate is controlled to maintain the velocity above the catalyst saltation level, and below erosion limits.

The transport oil continues to flow through the catalyst transfer vessel 14 into the reactor 10, as hereinabove described, until the density indicator 71, in line 33, indicates that the density approaches that of the oil, i.e., the catalyst has been removed from vessel 14. At this point, the transfer oil continues to flow through vessel 14 and the lines for a predetermined period of time to ensure that the vessel and various piping is cleared of any residual catalysts.

In withdrawing catalyst from either vessel 10 or 11, catalyst withdrawal line 72 of vessel 10 or catalyst withdrawal line 73 of vessel 11, is placed in communication with line 64, and the valving is arranged in a manner such that transport liquid from pump 34 flows through line 35, line 74, line 63 and line 75 into the top of the catalyst vessel 14. The oil overflows from vessel 14 through line 15, line 16 and line 76 for introduction into the separation and recovery portion of the reaction system. In particular, the oil overflowing from the reactor 14, which eventually flows into line 76, is preferably transferred to a portion of the recovery system, which initially receives the effluent from the reactors in that, as hereinafter described, the liquid in line 76 includes a portion of the liquid which is in the reactors. When, for example, line 73 of vessel 11 is placed in communication with line 64, during the catalytic withdrawal portion of the cycle, catalyst as well as reaction fluid in reactor 11, flows through line 73, and is combined with the transport oil in line 74. The solids slurried in the combined stream in line 64 is introduced into the transfer vessel 14, as hereinabove described wherein the solids are separated from the fluid. The fluid overflows to the separation and recovery portion of the reaction system through line 15, etc., as hereinabove described, i.e., the high pressure separator for the reaction effluent.

In accordance with the one aspect of the present invention, in order to maintain a predetermined rate of withdrawal of catalyst from the reactor 11, flow of the combined stream in line 64 is controlled by a valve 78 in line 76, which valve 78 may be controlled by either a flow controller 79 to maintain a predetermined flow rate in line 76, or by a temperature controller 81 to maintain a predetermined temperature in line 64. More particularly, the flow controller 54 is set to maintain a predetermined rate of flow of transport oil through line 35 and line 74, and in the case where valve 78 is controlled by temperature controller 81, the temperature set point of the temperature controller 81 is set to a value which corresponds to the temperature which would be achieved by mixing the stream in line 73 at the desired rate of flow with the stream in line 74. In other words, once the flow rate and temperature of transport oil in line 74 is known, and the temperature of the fluid flowing through line 73 is known, the temperature controller 81 is set to the temperature which would result from mixing stream 73, at the desired flow rate, with the stream in line 74. As an alternative, the temperature control may be expressed on liquid withdrawn from the transfer vessel 14; e.g. in line 16 or 76. The temperature in line 64 is maintained by controlling the flow of oil in line 76, which controls flow in line 73.

In the alternative, flow controller 79 may be employed, and the set point of the flow controller 79 is set so as to maintain a rate of flow in line 76 which produces the desired rate of flow through line 73, i.e., by fixing the rate of flow through lines 74 and 76 by flow controllers 54 and 79, respectively, the flow through line 73 is controlled. In this manner, flow of catalyst from the reactor is controlled by using a flow control system, rather than by attempting to obtain a desired flow by controlling pressure difference. Flow is achieved by the static level in the reactor and/or by selecting the point at which the transport liquid is returned to the high pressure portion of the reaction system.

The catalyst is withdrawn from the reactor 11 until the density indicator 82 for the vessel 14 indicates that the catalyst has reached the desired level in vessel 14. At this point, catalyst withdrawal line 73 is closed, and the system is flushed for a predetermined period of time with heavy gas oil (transport oil) so as to ensure that solids have been removed from the various lines.

At this point, it is necessary to remove any reaction fluid which remains in transfer vessel 14, and for this purpose, transport oil is caused to flow from pump 34 through lines 35, 36, 24, 25 and 26 into the bottom of the transfer vessel 14 for upward flow through the vessel 14 and through lines 15, 16 and 76 to thereby displace any reactor fluid from vessel 14 for introduction into the separation and recovery portion of the reaction system.

Once the washing is completed, the valving of the entire high-pressure portion of the system is aligned so as to place the entire high-pressure portion of the system in communication with the transport oil pump 34 for depressurization of the system. In the depressurization operation, the set point of the pressure controller is lowered; for example, to a pressure of less than 100 p.s.i.g. so as to lower the pressure in the system. Such depressurization is accomplished by increasing the amount of transport oil diverted through line 53.

After the system is depressurized, the heavy gas oil is displaced from transfer vessel 14 by passing light gas oil from drum 18 through line 19 and pump 22 through lines 24, 25 and 26 into the bottom of transfer vessel 14. The oil overflows vessel 14 through lines 15, 16, 37 and 39 to the separation and recovery portion of the reaction system through line 47. During this portion of the operation, the flow of oil from drum 18 is set at a lower value so as to minimize the impact on the fractionation system.

After the heavier transport oil has been displaced from transfer vessel 14, the catalyst and vessel 14 is cooled by circulating light gas oil from drum 18 through a closed recirculating cooling circuit. In particular, light gas oil flows from drum 18 through line 19, pump 22 lines 23, 24, 25 and 26 into the transfer vessel 14, and then overflows vessel 14 through lines 15, 16, 37, 39 and 41, and then through cooler 42, in line 43, back into the drum 18. As a result of the fact that the catalyst is cooled in a closed-loop loop system which does not impact on other processing units, the circulation rate may be increased so as to reduce the time for completing the cooling operation. Cooling is continued until both the temperature indicator 45 and the temperature indicator 44 indicate that the oil flowing in line 16, and the wall of the vessel 14, respectively, have reached a desired level.

At this point, the system is operated so as to remove the withdrawn catalyst from transfer vessel 14 to a holding bin 91. In this portion of the operation, oil flows from drum 18 through line 19, pump 22 and lines 23, 24, 25 and 26 into the bottom of vessel 14 wherein the solids are slurried in the oil. A slurry of solids in the oil is withdrawn from vessel 14 through line 61 and flows through lines 62, 63 and 92 into the removal bin 91 wherein catalyst is separated from the oil. The oil then overflows from bin 91 through line 93 for return to the drum 18.

As in the case of transporting catalyst from the vessel 14 to the reactors, in the case where catalyst is transported from vessel 14 to the bin 91, a portion of the light gas oil flowing through line 24 is diverted into vessel 14 through lines 27 and 15 so as to maintain a desired concentration of solids in the oil, which is withdrawn through line 61. The flow of oil is discontinued when the density detector 71 indicates that solids are no longer flowing through line 63.

Although the embodiment has been particularly described with reference to transferring withdrawn catalyst from transfer vessel 14 to the holding bin 91, it is to be understood that the catalyst withdrawn from one reactor may be transferred to a second reactor so as to provide for cascading of catalyst between reactors. For example, catalyst may be passed from one reactor to another, countercurrent to the flow of reactants between a series of reactors. In such a situation, the catalyst washing and cooling steps are omitted and after the catalyst is withdrawn from one reactor and introduced into the catalyst transfer vessel 14, the catalyst addition cycle is initiated for transferring the withdrawn catalyst from the transfer vessel 14 to a different reactor. It should be apparent, that in withdrawing catalyst from the final reactor for disposal, the catalyst is washed, cooled and transferred to the holding bin, as hereinabove described.

As is known in the art, in withdrawing catalyst from a reactor, only a portion of the catalyst is withdrawn from the reactor. Similarly, in the catalyst addition step, only a portion of the total catalyst inventory for the reactor is added in the catalyst addition step.

As should be apparent from the hereinabove described embodiment, in accordance with the present invention, there is provided a separate system for providing heated transport oil for introducing catalyst into the reactor, and a separate and distinct system for cooling withdrawn catalyst, and for passing withdrawn catalyst to a catalyst holding bin. In this manner, the systems are not subjected to temperature cycling which would occur where there is a single system for both heating and cooling of catalyst.

Moreover, in accordance with the present invention, as described with reference to the preferred embodiment, during catalyst addition, the rate of flow of the slurry is controlled by maintaining a predetermined flow of transport liquid to the transfer vessel, without imposing pressure control. Thus, in accordance with this aspect of the present invention, the transport oil is maintained at a predetermined flow rate, rather than setting a predetermined pressure to maintain flow.

In accordance with still another aspect of the present invention, it is possible to use a single catalyst transfer vessel for both adding and withdrawing catalyst, and if two or more transfer vessels are employed, each of the transfer vessels may be employed for both introducing and withdrawing catalyst.

In accordance with stil another aspect of the present invention, in withdrawing catalyst from the reactor, a desired rate of withdrawal of the catalyst may be obtained by controlling the flow of a combined liquid stream comprised of transport oil and reactor fluid withdrawn from the catalyst transfer vessel so as to maintain either a fixed flow rate of the combined liquid stream, or a fixed temperature for the slurry introduced into the transfer vessel or the liquid removed from the transfer vessel.

Although the invention has been described with respect to a preferred embodiment it is to be understood that the invention may be practiced otherwise than as particularly described. Thus, for example, although the embodiment has been described with respect to the use of heavy gas oil and a light gas oil, it is to be understood that other liquids may be employed for transporting solids, and for cooling and washing the solids. Thus, for example, the transport liquid may be a hydrocarbon liquid from the system, other than the one described. Alternatively, the transport liquid and/or cooling liquid may be derived from a source other than the hydrogenation system, although it is preferred to employ materials which are present in the hydrogenation system.

It is also to be understood that although a specific piping arrangement has been described, other piping arrangements may be employed within the spirit and scope of the present invention.

Although the embodiment has been particularly described with respect to catalyst addition and withdrawal, it is to be understood that the invention may be employed for adding and withdrawing solids, other than catalyst. Similarly, although the invention is particularly applicable to adding and withdrawing catalyst in a high pressure system; for example, a system operating at 500 PSIG or greater, and preferably 1,000 PSIG or greater, the teachings of the invention are also applicable to other systems.

The present invention is particularly applicable to adding and withdrawing solids, in particular catalyst, for an expanded bed hydrogenation reactor. As known in the art, such expanded bed hydrogenation reactors are employed for upgrading feed stocks from both petroleum and coal sources, with the feed stock generally being one which has at least 25% of components boiling above 850° F. In general, such reactors are operated at a pressure of 500 PSIG to 4,000 PSIG, and at temperatures in the order of 650° F. to 900° F. The catalyst employed in the expanded bed reactor is a hydrogenation catalyst of a type known in the art; such as, for example, cobalt-molybdate with the catalyst generally being supported on a suitable support, such as alumina or silica-alumina.

The present invention is particularly advantageous in that it provides for effective addition and withdrawal of solids; in particular catalyst, in a high pressure system; in particular a system for hydrogenating a feed in an expanded bed. The present invention provides for improved control of the system. Moreover, by employing the present invention, it is possible to employ a single transfer vessel for both addition and withdrawal, and to provide for effective pressurization, heating, and cooling of solids in the system.

These and other advantages should be apparent to those skilled in the art from the teachings herein.

Modifications and variations of the present invention are possible in light of the above teachings, and, therefore, within the scope of the appended claims, the invention may be practiced otherwise than as particularly described.

What is claimed is:

1. A process for withdrawing solids containing a reaction liquid by use of a catalyst withdrawal system, comprising:

withdrawing a first stream comprising solids and a reaction liquid from a reactor; combining the first stream with a second stream comprising a transport liquid to provide a combined stream for transporting solids to a catalyst withdrawal vessel; maintaining a set flow rate for the second stream; withdrawing a mixture of reactor liquid and transport liquid from the vessel; and maintaining a rate of withdrawal of the first stream by controlling the flow rate of the mixture to maintain one of a set flow rate for the mixture or a set temperature of the combined stream or a set temperature of the mixture.

2. The process of claim 1 wherein the flow rate of the mixture is controlled to maintain a set temperature for the combined stream.

3. The process of claim 1 wherein the flow rate of the mixture is controlled to maintain a set temperature for the mixture.

4. The process of claim 1 wherein the flow rate of the mixture is controlled to maintain a set flow rate therefor.

5. The process of claim 1 wherein the solids are a hydrogenation catalyst withdrawn with reaction liquid from an expanded bed hydrogenation reactor operated at a pressure of from 500 to 4,000 psig.

6. The process of claim 5 wherein the flow rate of the mixture is controlled to maintain a set temperature for the combined stream.

* * * * *